US009962924B2

(12) United States Patent
Carreras

(10) Patent No.: US 9,962,924 B2
(45) Date of Patent: May 8, 2018

(54) APPARATUS FOR FORMING HIGH DEFINITION LITHOGRAPHIC IMAGES ON CONTAINERS

(71) Applicant: Ball Corporation, Broomfield, CO (US)

(72) Inventor: Chris Carreras, Erie, CO (US)

(73) Assignee: BALL CORPORATION, Broomfield, CO (US)

( * ) Notice: Subject to any disclaimer, the term of this patent is extended or adjusted under 35 U.S.C. 154(b) by 0 days. days.

(21) Appl. No.: 15/231,128

(22) Filed: Aug. 8, 2016

(65) Prior Publication Data

US 2016/0347048 A1 Dec. 1, 2016

Related U.S. Application Data

(62) Division of application No. 14/301,018, filed on Jun. 10, 2014, now Pat. No. 9,409,433.

(60) Provisional application No. 61/833,799, filed on Jun. 11, 2013.

(51) Int. Cl.

| | |
|---|---|
| ***B41N 1/00*** | (2006.01) |
| ***B41F 7/16*** | (2006.01) |
| ***B41F 17/08*** | (2006.01) |
| ***B41M 1/40*** | (2006.01) |
| ***B41M 1/22*** | (2006.01) |
| ***B41M 1/04*** | (2006.01) |
| ***B41M 1/06*** | (2006.01) |
| ***B41F 17/22*** | (2006.01) |
| *B41M 1/20* | (2006.01) |
| *B41M 1/28* | (2006.01) |
| *B41F 17/14* | (2006.01) |

(52) U.S. Cl.

CPC ..... *B41F 7/16* (2013.01); *B41F 17/08* (2013.01); *B41F 17/22* (2013.01); *B41M 1/04* (2013.01); *B41M 1/06* (2013.01); *B41M 1/22* (2013.01); *B41M 1/40* (2013.01); *B41N 1/006* (2013.01); *B41F 17/14* (2013.01); *B41M 1/20* (2013.01); *B41M 1/28* (2013.01)

(58) Field of Classification Search

CPC ..... B41F 7/08
USPC ..... 101/453
See application file for complete search history.

(56) References Cited

U.S. PATENT DOCUMENTS

| | | | |
|---|---|---|---|
| 3,286,302 | A | 11/1966 | Doering |
| 3,752,073 | A | 8/1973 | Lorber |
| 3,766,851 | A | 10/1973 | Sirvet et al. |

(Continued)

FOREIGN PATENT DOCUMENTS

| | | |
|---|---|---|
| CA | 2097619 | 5/1992 |
| CN | 101808825 | 8/2010 |

(Continued)

OTHER PUBLICATIONS

Official Action for Australia Patent Application No. 2014278307, dated Mar. 3, 2017 4 pages.

(Continued)

*Primary Examiner* — Anthony Nguyen
(74) *Attorney, Agent, or Firm* — Sheridan Ross PC

(57) ABSTRACT

The present invention relates to using soft photopolymer plates in a printing process, and more specifically, to an apparatus and methods of using soft photopolymer materials to decorate an exterior surface of cylindrical metallic containers with high definition graphics and other indicia.

20 Claims, 10 Drawing Sheets

(56) References Cited

U.S. PATENT DOCUMENTS 3,991,673 A 11/1976 Coale et al.
4,142,462 A 3/1979 Gilgore
4,384,518 A 5/1983 Albin
4,395,946 A 8/1983 Price
4,519,310 A 5/1985 Shimizu et al.
4,884,504 A 12/1989 Sillars
4,889,560 A 12/1989 Jaeger et al.
4,898,752 A 2/1990 Cavagna et al.
4,903,599 A 2/1990 Kubler et al.
5,010,814 A 4/1991 Shishikura
5,049,432 A 9/1991 Ooms et al.
5,181,471 A 1/1993 Sillars
5,213,043 A 5/1993 Reimers et al.
5,282,306 A 2/1994 Katsuhiro
5,339,731 A 8/1994 Howard et al.
5,351,617 A 10/1994 Williams et al.
5,353,703 A 10/1994 Rieker
5,385,092 A 1/1995 Lewis et al.
5,469,787 A 11/1995 Turner et al.
5,502,476 A 3/1996 Neal et al.
5,591,255 A 1/1997 Small et al.
5,713,288 A 2/1998 Frazzitta
5,806,427 A * 9/1998 Niemiro ..... B41F 7/04 101/247
5,908,505 A 6/1999 Bargenquest et al.
5,919,839 A 7/1999 Titterington et al.
5,970,865 A 10/1999 Horth et al.
5,974,974 A 11/1999 Agnew et al.
6,037,101 A 3/2000 Telser et al.
6,058,839 A 5/2000 Frazzitta
6,139,779 A 10/2000 Small et al.
6,174,937 B1 1/2001 Banning et al.
6,196,675 B1 3/2001 Deily et al.
6,238,837 B1 5/2001 Fan
6,309,453 B1 10/2001 Banning et al.
6,312,872 B1 * 11/2001 Murphy ..... B41C 1/05 430/22
6,395,123 B1 5/2002 Fromson et al.
6,494,950 B1 12/2002 Fujita et al.
6,543,350 B2 4/2003 Gilliam et al.
6,550,389 B1 4/2003 Goto et al.
6,553,907 B2 4/2003 Richards
6,594,927 B2 7/2003 Witkowski
6,640,713 B2 11/2003 Landsman
6,651,559 B2 11/2003 Haraux et al.
6,779,445 B2 8/2004 Schaede
6,779,455 B2 8/2004 Figov et al.
6,899,998 B2 5/2005 Figov
6,920,822 B2 7/2005 Finan
7,309,563 B2 12/2007 Paul et al.
7,464,642 B2 12/2008 Schaede
7,691,549 B1 * 4/2010 Glasser ..... G03F 7/2026 430/22
7,810,922 B2 10/2010 Gervasi et al.
7,997,199 B2 8/2011 Watanabe et al.
8,034,207 B2 10/2011 Hunahata
8,409,698 B2 4/2013 Byers et al.
8,544,385 B2 10/2013 Schuler-Cossette et al.
9,409,433 B2 8/2016 Carreras
9,475,276 B2 10/2016 Fleischer et al.
9,573,358 B2 * 2/2017 Boas ..... B41M 1/40
2002/0083855 A1 7/2002 Samworth
2002/0178945 A1 12/2002 Richards
2003/0015105 A1 1/2003 Dewig
2003/0056410 A1 3/2003 Witkowski
2003/0089261 A1 5/2003 Landsman
2003/0101885 A1 6/2003 Jordan
2003/0150346 A1 8/2003 Haraux et al.
2004/0011234 A1 1/2004 Figov et al.
2004/0126682 A1 * 7/2004 Dreher ..... B41C 1/00 430/11
2004/0173110 A1 9/2004 Roesch
2004/0191693 A1 * 9/2004 Takamiya ..... B41C 1/1008 430/302
2005/0098051 A1 5/2005 Flint et al.
2006/0019196 A1 1/2006 Miyoshi
2009/0303307 A1 12/2009 Yasumatsu
2010/0031834 A1 2/2010 Morgavi et al.
2010/0229737 A1 9/2010 Ouchi
2010/0295885 A1 11/2010 LaCaze
2010/0319555 A1 * 12/2010 Hashimoto ..... B41F 13/10 101/36
2011/0104615 A1 5/2011 Sievers
2011/0126760 A1 6/2011 Daems et al.
2011/0162542 A1 7/2011 Nakamura et al.
2011/0283905 A1 11/2011 Sakata
2012/0103216 A1 5/2012 Knisel et al.
2012/0204746 A1 8/2012 Fullgraf
2012/0238675 A1 9/2012 Kataura et al.
2012/0274695 A1 11/2012 LaCaze et al.
2012/0315412 A1 12/2012 Clayton et al.
2013/0075675 A1 3/2013 Krutak et al.
2013/0105743 A1 5/2013 Owen et al.
2013/0176358 A1 7/2013 Yamada et al.
2013/0228086 A1 9/2013 Baldwin et al.
2013/0231242 A1 9/2013 Clayton et al.
2013/0242276 A1 9/2013 Schadebrodt et al.
2013/0340885 A1 12/2013 Clayton et al.
2014/0039091 A1 2/2014 Owen et al.
2014/0072442 A1 3/2014 Bowman et al.
2014/0187668 A1 7/2014 Owen et al.
2014/0210201 A1 7/2014 Owen et al.
2014/0212654 A1 7/2014 Clayton et al.
2014/0272161 A1 9/2014 Clayton et al.
2015/0174891 A1 6/2015 Boas et al.
2015/0183211 A1 7/2015 Petti et al.
2015/0217559 A1 8/2015 Carreras et al.
2015/0290923 A1 10/2015 Treloar
2016/0001546 A1 1/2016 Hughes et al.
2016/0129687 A1 5/2016 Boas et al.
2017/0013452 A1 4/2017 Boas et al.
2017/0096001 A1 4/2017 Carreras et al.

FOREIGN PATENT DOCUMENTS

CN 102143846 8/2011
CN 103109233 5/2013
DE 102006025897 1/2007
EP 202928 11/1986
EP 545862 6/1993
EP 0717320 6/1996
EP 968491 1/2000
EP 1590177 11/2005
EP 1684990 8/2006
EP 2153991 2/2010
EP 2196314 6/2010
EP 2242595 10/2010
EP 2317387 5/2011
EP 2384890 11/2011
EP 2701912 3/2014
EP 2809521 12/2014
EP 2943339 11/2015
GB 1298205 11/1972
GB 2512678 10/2014
JP 2000-258899 9/2000
JP 2001/030612 2/2001
JP 2007/076209 3/2007
KR 10-2006-0004679 1/2006
WO WO 1990/02044 3/1990
WO WO 94/07693 4/1994
WO WO 98/17474 4/1998
WO WO 98/41966 9/1998
WO WO 00/27644 5/2000
WO WO 2009/090389 7/2009
WO WO 2013/028804 2/2013
WO WO 2013/115800 8/2013
WO WO 2013/155423 10/2013
WO WO 2014/006517 1/2014
WO WO 2014/008544 1/2014
WO WO 2014/096088 6/2014
WO WO 2014/128200 8/2014

(56) References Cited

FOREIGN PATENT DOCUMENTS

| | | |
|---|---|---|
| WO | WO 2014/144853 | 9/2014 |
| WO | WO 2015/101828 | 7/2015 |
| WO | WO 2016/183452 | 11/2016 |

OTHER PUBLICATIONS

Official Action for Canada Application No. 2,914,050, dated Mar. 8, 2017 3 pages.
Official Action (English translation) for Chinese Patent Application No. 201480039926.X, dated Oct. 28, 2016, 10 pages.
Extended Search Report for European Patent Application No. 14810948.1, dated Apr. 11, 2017 10 pages.
Third Party Observations for European Patent Application No. 14810948.1, dated Dec. 21, 2016 5 pages.
Notice of Allowance with English Translation for Japan Patent Application No. 2016-519592, dated Jan. 11, 2017 2 pages.
"Chemical milling," Wikipedia, Feb. 13, 2015, retrieved from http://en.wikipedia.org/Wiki/Chemical_milling, 6 pages.
"DuPont™ Cyrel®: CyrelTM Digital flex plate Imagers (CDI)" DuPont, 2009, retreived from http://www2.dupont.com/Packaging_Graphics/en_GB/assets/downloads/pdf/CDI_family_English.pdf, 8 pages.
"DuPont™ Cyrel® DPR: Robust Digital Plate for Highest Quality Printing," DuPont, 2010, retrieved from http://www2.dupont.com/Packaging_Graphics/en_US/assets/downloads/pdf/DP_Cyrel_DS_DPR_us_low.pdf, 2 pages.
"DuPont™ Cyrel® NOWS: Rugged, High-Performance Analog Plate," DuPont, 2007, retreived from http://www2.dupont.com/Packaging_Graphics/en_US/assets/downloads/pdf/Cyrel_NOWS.pdf, 2 pages.
"EPDM rubber," Wikipedia, Oct. 24, 2014, retrieved from http://enwikipedia.org/wiki/EPDM_rubber, 3 pages.
"Flexographic ink," Wikipedia, Sep. 18, 2014, retrieved from http://en.wikipedia.org/wiki/Flexographic_ink, 2 pages.
"Flexography," Wikipedia, Dec. 15, 2014, retrieved from http://en.wikipedia.org/wiki/Flexographic, 6 pages.
"Laser engraving," Wikipedia, Jan. 16, 2015, retrieved from http://en.wikipedia.org/wiki/Laser_engraving, 10 pages.
"Luminous paint,"Wikipedia, Jul. 7, 2014, retrieved from http://en.wikipedia.org/wiki/Luminous_paint, 4 pages.
"Offset Lithography," PrintWiki, retrieved Feb. 9, 2015 from http://printwiki.org/Offset_Lithography, 8 pages.
"Offset printing," Wikipedia, Dec. 11, 2014, retrieved from http://en.wikipedia.org/wiki/Offset_Printing, 12 pages.
"Plate," PrintWiki, retrieved Feb. 9, 2015 from http://printwiki.org/Plate, 6 pages.
"Printmaking," Wikipedia, Feb. 12, 2015, retrieved from http://en.wikipedia.org/wiki/Printmaking, 14 pages.
Bodwell et al., "Advancing Flexography: The Technical Path Forward," DuPont, 2011, retrieved from www2.dupont.com/Packaging_Graphics/en_US/assets/downloads/pdf/AdvFlexo_Brochure.pdf, 12 pages.
Mine, "How Offset Printing Works," retrieved on Feb. 9, 2015 from www.howstuffworks.com/offset-printing.htm/printable, 5 pages.
International Search Report and Written Opinion for International Patent Application No. PCT/US14/41713, dated Oct. 10, 2014, 8 pages.
International Preliminary Report on Patentability for International (PCT) Patent Application No. PCT/US2014/041713, dated Dec. 23, 2015 7 pages.
Official Action for U.S. Appl. No. 14/301,018, dated May 13, 2015, 5 pages.
Official Action for U.S. Appl. No. 14/301,018, dated Aug. 14, 2015 10 pages.
Official Action for U.S. Appl. No. 14/301,018, dated Dec. 15, 2015 8 pages.
Notice of Allowance for U.S. Appl. No. 14/301,018, dated Apr. 6, 2016 10 pages.
Official Action for U.S. Appl. No. 14/686,517, dated Oct. 15, 2015 5 pages Restriction Requirement.
Official Action for U.S. Appl. No. 14/686,517, dated Jan. 15, 2016 8 pages.
Official Action for U.S. Appl. No. 14/005,873, dated Aug. 26, 2015, 27 pages.
Official Action for Canada Patent Application No. 2,914,050, dated Jul. 7, 2016 3 pages.
Official Action (with English translation) for Panama Patent Application No. 90961, dated May 12, 2016, 8 pages.
International Search Report and Written Opinion for International (PCT) Patent Application No. PCT/US16/27576, dated Jul. 22, 2016 8 pages.
Official Action for U.S. Appl. No. 14/686,517, dated Jul. 6, 2016 9 pages.
Notice of Allowance for U.S. Appl. No. 14/686,517, dated Sep. 13, 2016 9 pages.
Corrected Notice of Allowance for U.S. Appl. No. 14/686,517, dated Sep. 28, 2016 6 pages.
Notice of Acceptance for Australia Patent Application No. 2014278307, dated Sep. 13, 2017 3 pages.
English Translation of Official Action for Colombia Patent Application No. 15-304586, dated Aug. 23, 2017 6 pages.
Notice of Allowance for Mexico Patent Application No. MX/a/2015/016969, dated Aug. 17, 2017 2 pages.
English Translation of Official Action for China Patent Application No. 2017061601514530, dated Jun. 21, 2017 9 pages.
Official Action for Russia Patent Application No. 2015156266, dated May 31, 2017 4 pages.
Decision to Grant for Russia Patent Application No. 2015156266, dated Jun. 8, 2017 12 pages.
English Translation of Official Action for China Patent Application No. 201480039926.X, dated Jan. 2, 2018 6 pages.
Notice of Allowance with English Translation for Japan Patent Application No. 2017-023060, dated Nov. 14, 2017 2 pages.
International Preliminary Report on Patentability for International (PCT) Patent Application No. PCT/US2016/027576, dated Oct. 26, 2017 19 pages.
Notice of Grant with machine translation for Chile Patent Application No. 3604-2015, dated Jan. 22, 2018 4 pages.
Third Party Observations for European Patent Application No. 14810948.1, dated Jan. 29, 2018 5 pages.

* cited by examiner

APPARATUS FOR FORMING HIGH DEFINITION LITHOGRAPHIC IMAGES ON CONTAINERS

CROSS-REFERENCE TO RELATED APPLICATIONS

This application is a divisional application of and claims priority to U.S. patent application Ser. No. 14/301,018, filed on Jun. 10, 2014 and entitled "Printing Process Using Soft Photopolymer Plates," which claims priority under 35 U.S.C. § 119(e) to U.S. Provisional Patent Application Ser. No. 61/833,799 filed Jun. 11, 2013, which are each incorporated herein by reference in their entirety.

FIELD OF THE INVENTION

The present invention relates to using soft photopolymer plates in a printing process for cylindrical substrates. More specifically, the present invention relates to a method and apparatus which use soft photopolymer plates to decorate the exterior surface of cylindrical metallic containers in a printing process.

BACKGROUND

Metallic containers are frequently decorated with an image or indicia, such as a brand name, logo, product information, or design, using a lithographic printing process. In lithographic printing, one or more printing plates with image regions are attached to a plate cylinder (or press cylinder) of a decorator. The image regions can include both ink receiving regions and areas that do not receive ink. An inker applies ink to the printing plates and the ink adheres to the ink receiving regions. Usually each printing plate receives a particular color of ink from the inker. The decorator also has a blanket cylinder (also known as an offset cylinder, a printing cylinder, or a segment wheel). Printing blankets (or secondary transfer plates) are attached to the blanked cylinder. Decorators used in the metallic container industry typically have from 8 to 12 printing blankets on the blanket cylinder. As the plate cylinder and blanket cylinder are rotated in unison, each of the one or more printing plates contacts a printing blanket and transfers a particular color of ink to the printing blanket. When all of the printing plates have transferred their ink colors and images to the printing blanket, the final lithographic image is formed on the printing blanket. A metallic container is then brought into rotational contact with the printing blanket of the blanket cylinder and the lithographic image is transferred from the printing blanket to the exterior surface of the metallic container.

Lithographic printing methods are described in U.S. Pat. No. 4,384,518, U.S. Pat. No. 6,550,389, and U.S. Pat. No. 6,899,998, which are each incorporated herein by reference in their entireties. The methods described in these references only allow a single lithographic image to be produced from a single set of printing plates. Therefore, the methods described in these patents are only efficient for printing the same image onto a large number of metallic containers. In order to print a different image on the metallic containers, a new set of printing plates must be installed on the plate cylinder of the decorator, resulting in downtime and decreased efficiency of a production line. Because only one image can be printed without changing the printing plates, it is economically challenging to produce small batches of decorated metallic containers with different images.

One example of providing multiple images from a single set of printing plates is provided in International Patent Publication No. WO 2014/008544, which is herein incorporated by reference in its entirety. This reference describes a blanket cylinder with printing blankets that are adapted to have inked regions and non-inked regions. The non-inked regions are recessed inwardly and are formed by laser cutting, etching, water blasting, routing, drilling, engraving, or molding. However, lithographic images produced by the non-inked regions formed on the printing blankets using these techniques do not have enough detail to be considered a high quality, high-definition image. The commercial metallic container industry requires high-definition printing in unique applications and requires distinct graphical elements that can efficiently be printed with high resolution and detail on the exterior surface of a metallic container. These high-definition images are necessary to differentiate products at the point of sale and to attract consumers.

Accordingly, there is an unmet need for a high-definition lithographic printing process that allows multiple images to be printed on an exterior surface of a metal container from a single set of printing plates without sacrificing production efficiency or image quality and detail.

SUMMARY OF THE INVENTION

The present process uses soft photopolymer plates affixed to a blanket cylinder of a decorator to significantly enhance the image quality and detail of lithographic images printed on metallic containers. More specifically, an image is transferred to a face of a soft photopolymer plate by exposing the soft photopolymer plate with light. The image can be transferred using a computer to plate process or a conventional plate exposure process. This results in a soft photopolymer plate which has relief areas that do not receive ink and hardened areas forming precise and detailed image areas that will receive ink. In some embodiments of the process, the soft photopolymer plates may also be etched or engraved on the face before, during, or after the curing process to form one or more recessed portions that do not receive ink. These and other advantages will be apparent from the disclosure of the invention(s) contained herein.

In accordance with one aspect of the present invention, a novel method of using a soft photopolymer plate in a lithographic printing process to decorate an exterior surface of a metallic container is provided. This includes, but is not limited to, a method generally comprising: (1) providing a first image to be printed onto an exterior surface of the metallic container; (2) transferring the first image to a predetermined portion of a face portion of the soft photopolymer plate; (3) removably affixing the soft photopolymer plate with a transferred first image onto a blanket cylinder of a decorator; (4) attaching printing plates to at least one plate cylinder of the decorator; (5) applying ink from an inker to the printing plates; (6) transferring the ink from the printing plates to at least a portion of the soft photopolymer plate and the transferred first image; and (7) transferring the ink from the soft photopolymer plate to the exterior surface of the metallic container, wherein the metallic container is decorated with the first image. Additionally or alternatively, the method may further comprise: (8) removably affixing from about 8 to about 12 soft photopolymer plates onto the blanket cylinder, wherein the about 8 to the about 12 soft photopolymer plates each have different images, and wherein ink transferred from the about 8 to the about 12 soft photopolymer plates produces 8 to 12 different images on about 8 to the about 12 metallic containers; (9) etching or engraving the face portion of the soft photopolymer plate to form one or more recessed portions, and/or (10) providing a second image to be printed onto an exterior surface of the metallic container, transferring the second image to the printing plates, and decorating the metallic container with the first image and the second image.

Transferring the first image to the predetermined portion of the face portion of the soft photopolymer plate generally comprises: (1) creating a film negative of the first image; (2) placing the film negative on the predetermined portion of the face portion of the soft photopolymer plate; (3) exposing the soft photopolymer plate and the film negative to a light source, wherein a material of the soft photopolymer plate hardens in predetermined locations where light passes through the film negative, and wherein the material of the photopolymer plate remains unexposed and soft in predetermined locations where the light is blocked by the film negative; (4) removing the film negative from the soft photopolymer plate; and (5) placing the soft photopolymer plate in a washing station and cleaning the soft photopolymer plate to remove the soft, unexposed material of the soft photopolymer plate to reveal the transferred first image.

Additionally or alternatively, transferring the first image to the predetermined portion of the face portion of the soft photopolymer plate may generally comprise: (1) creating the first image; (2) ablating portions of an opaque mask coating on the face portion of the soft photopolymer plate to form a negative of the first image; (3) exposing the soft photopolymer plate to a light source, wherein a polymer material of the soft photopolymer plate hardens in predetermined locations where the masking coating has been ablated, and wherein the polymer material of the photopolymer plate remains unexposed and soft in predetermined locations where the light is blocked by the mask coating; and (4) removing the soft, unexposed polymer material of the soft photopolymer plate to reveal the transferred first image.

In one embodiment, the light source is an ultraviolet light source. In another embodiment, the soft photopolymer plate and the film negative are exposed to the light source for from about 0.01 minute to about 10 minutes. In one embodiment, the washing station uses a solvent to clean the soft photopolymer plate. In another embodiment, the washing station uses water to clean the soft photopolymer plate.

The soft photopolymer plate is formed of any mixture of materials that harden or form a different texture after exposure to ultraviolet or visible light. In one embodiment, the soft photopolymer plate is comprised of one of elastomers which are cured using a light-catalyzed photopolymerization process, chloroprene crosslinked with trimethylolpropane triacrylate, and styrene-isoprene rubber with a polyacrylate. In another embodiment, before the first image is transferred to the soft photopolymer plate, the soft photopolymer plate has a hardness of from about 40 durometers to about 110 durometers. In another embodiment, the transferred first image on the soft photopolymer plate has a depth of from about 0.0009 inch to about 0.089 inch. In one embodiment, each of the different images are formed in a same location on each of the soft photopolymer plates. In another embodiment, only one of the printing plates attached to the at least one plate cylinder transfers ink to the different images formed on each of the soft photopolymer plates and each of the other printing plates attached to the at least one plate cylinder transfer ink to other predetermined portions of each of the soft photopolymer plates. In one embodiment, the metallic container is generally cylindrical in shape and the first image is transferred to a curved exterior surface of the metallic container. In another embodiment, the metallic container is generally cylindrical in shape and the first image is transferred to a substantially flat exterior surface of the metallic container. In yet another embodiment, the metallic container is not cylindrical in shape and the first image is transferred to a flat exterior surface of the metallic container.

In accordance with another aspect of the present invention, an apparatus for forming a high-definition lithographic image on an exterior surface of a metallic container is disclosed, the apparatus operable to create multiples lithographic images from a single set of printing plates. The apparatus generally comprises: (1) at least one plate cylinder with an inker, the inker operable to transfer ink to predetermined portions of one or more printing plates attached to a circumference of the at least one plate cylinder; (2) a blanket cylinder, the blanket cylinder having one or more soft photopolymer plates affixed to a circumference of the blanket cylinder, the blanket cylinder operable to move the soft photopolymer plates into rotational contact with a printing plate attached to the at least one plate cylinder, wherein ink is transferred from the predetermined portions of the printing plate to at least a portion of the soft photopolymer plates, and wherein the soft photopolymer plates each have an image formed thereon; and (3) a support cylinder, the support cylinder including a plurality of stations adapted to receive metallic containers, the support cylinder operable to receive the metallic container from a conveyor and move the metallic container into contact with a soft photopolymer plate affixed to the blanket cylinder, wherein ink is transferred from the soft photopolymer plate to the metallic container to form the high-definition lithographic image on the exterior surface of the metallic container.

In one embodiment, the at least one plate cylinder and the support cylinder rotate in a first direction and the blanket cylinder rotates in an opposite second direction. In another embodiment, from about 8 to about 12 soft photopolymer plates are affixed to the circumference of the blanket cylinder. In still another embodiment, each of the soft photopolymer plates has a different image formed thereon, and each of the different images are generally formed by: (1) creating a film negative of each different image; (2) placing the film negatives on predetermined portions of the soft photopolymer plates; (3) exposing the soft photopolymer plates and the film negatives to a light source; (4) removing the film negatives from the soft photopolymer plates; and (5) washing the soft photopolymer plates to remove unexposed soft material of the soft photopolymer plates to reveal the different images. In one embodiment, each of the different images are formed in a same location on each of the soft photopolymer plates. In another embodiment, only one of the printing plates attached to the at least one plate cylinder transfers ink to the different images formed on each of the soft photopolymer plates, and the other printing plates attached to the at least one plate cylinder transfer ink to other predetermined portions of each of the soft photopolymer plates. In one embodiment, a second image is formed on the printing plates and the second image is transferred from the printing plates to the soft photopolymer plates and then to the exterior surface of the metallic container. In another embodiment, no image is formed on the printing plates but the printing plates convey ink to the soft photopolymer plates. In still another embodiment, the metallic container is generally cylindrical in shape. In yet another embodiment, the metallic container is not cylindrical in shape. In one embodiment, the ink is transferred from the soft photopolymer plate to one or more of a generally cylindrical exterior surface and a non-cylindrical exterior surface of the metallic container.

In still another embodiment, one of the printing plates has an area aligning with and operable to transfer ink to the different images on each of the soft photopolymer plates. Each of the other printing plates have a relief area aligning with the different images on each of the soft photopolymer plates, and the relief areas will not transfer ink to the different images. The area of the one printing plate and the relief areas of the other printing plates are located in corresponding locations on all of the printing plates and have the same general size and shape. In one embodiment, the area and the relief area have a shape selected from the group consisting of a parallelogram, a square, a rectangle, a circle, or any combination thereof. In a more preferred embodiment, the area and the relief area have a generally rectangular shape.

It is another aspect of the present invention to provide soft photopolymer plate adapted to form a high-definition lithographic image on an exterior surface of a metallic container in a printing process. The soft photopolymer plate generally comprises a plate body of a predetermined size and hardness, the plate body having a face portion and a back portion, wherein the back portion is adapted to be attached to a blanket cylinder of a decorator. An image formed on the face portion by creating a film negative of the image. The film negative is placed on a predetermined portion of the face portion. The face portion and the film negative are exposed to a light source. The film negative is removed from the face portion, and subsequently the soft photopolymer plate is cleaned to remove unexposed soft material from the face portion. In one embodiment, before the image is formed on the face portion, the soft photopolymer plate has a hardness of from about 40 durometers to about 110 durometers. In another embodiment, the plate body is from about 0.04 inch to about 0.1 inch thick. In one embodiment, the metallic container has a body with a generally cylindrical shape.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described below. Further, the Summary of the Invention is neither intended nor should it be construed as representing the full extent and scope of the present invention. The present invention is set forth in various levels of detail in the Summary of the Invention, and, in the attached drawings and the Detailed Description of the invention and no limitation as to the scope of the present invention is intended to either the inclusion or non-inclusion of elements, components, etc. in this Summary of the Invention. Additional aspects of the present invention will become more readily apparent from the detailed description, particularly when taken with the drawings.

Although generally referred to herein as "metallic can," "metallic containers," and/or "cylindrical metallic containers," it should be appreciated that the current process may be used to decorate any variety or shape of containers or other articles of manufacture, including generally cylindrical surfaces and non-cylindrical surfaces (including flat substrates) whether made of metal or other materials.

References made herein to "lithographic printing" or aspects thereof should not necessarily be construed as limiting the present invention to a particular method or type of printing. It will be recognized by one skilled in the art that the present invention may be used in other printing processes such as offset printing, dry offset printing, gravure printing, intaglio printing, screen printing, and inkjet printing.

The phrases "photopolymer plates," "soft photopolymer plates," "soft photopolymer material," and "soft photopolymer blankets" may be used interchangeably and refer to plates or blankets including a photopolymer material. Thus, the soft photopolymer plate may be a photopolymer printing plate that is a digital plate, a conventional analog plate, or a cylinder coated with a photopolymer. Additionally, or alternatively, the soft photopolymer plate may be round or a sleeve adapted to fit around a circumference of a blanket cylinder.

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

Figure 1A:
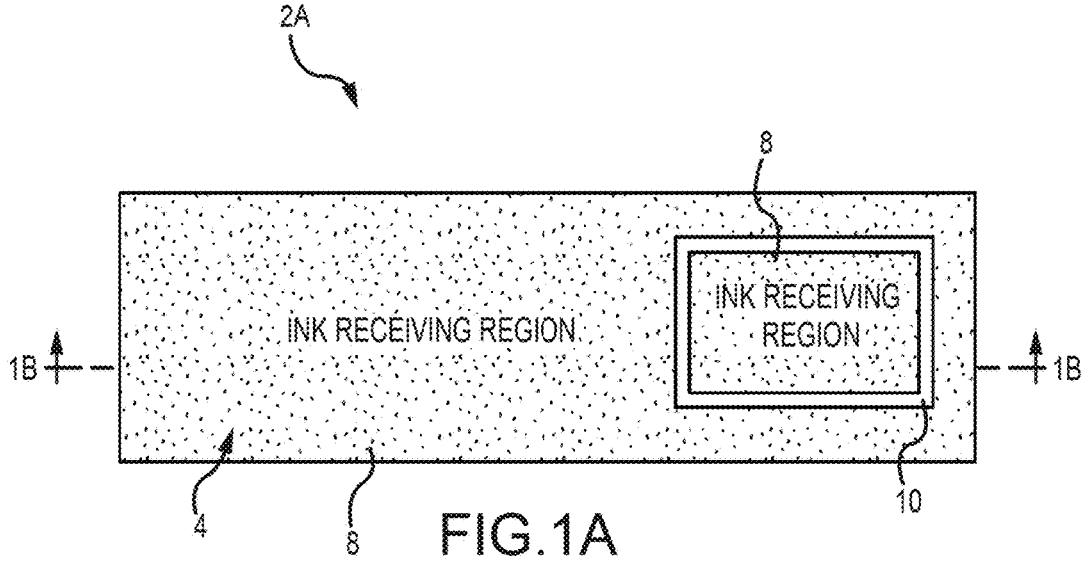
FIG. 1A is a top plan view of a printing plate with an engraved or etched area according to one embodiment of the present invention.

To assist in the understanding of one embodiment of the present invention the following list of components and associated numbering found in the drawings is provided herein:

| Number | Component |
|---|---|
| 2 | Printing plate |
| 4 | Face portion |
| 6 | Back portion |
| 8 | Ink receiving region |
| 10 | Non-ink region |
| 12 | Relief area |
| 14 | Soft photopolymer plate |
| 16 | Ink receiving region |
| 18 | Image |
| 20 | Relief area |
| 22 | Screened area |
| 24 | Decorator |
| 26 | Plate cylinder |
| 28 | Inker |
| 30 | Rollers |
| 32 | Blanket cylinder |
| 34 | Metallic container |
| 36 | Conveyor |
| 38 | Support cylinder |
| 40 | Station for metallic container |
| 42 | Storage facility |

-continued

| Number | Component |
|---|---|
| 44 | Container surface |
| 46 | Non-inked portion |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Figure 1B:
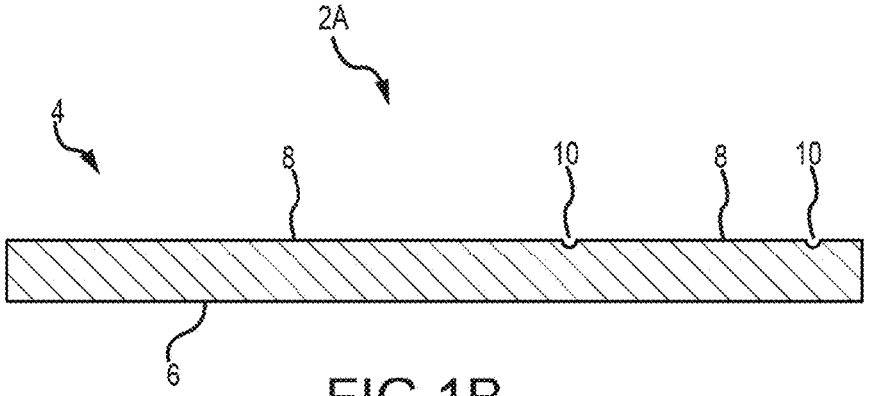
FIG. 1B is a cross-sectional elevation view of the printing plate of FIG. 1A taken along line 1B.

Referring now to FIGS. 1A and 1B, a printing plate 2A is illustrated. The printing plate 2A has a face portion 4 and a back portion 6. One or more ink receiving regions 8 adapted to receive and transfer ink to a soft photopolymer plate are formed in the face portion 4 by any means known to those of skill in the art. The inked receiving regions 8 of the printing plate 2A transfer a single tone, image, or text to the soft photopolymer plate during a printing process. One or more non-ink regions 10 may be formed in the printing plate. The non-ink regions 10 may be formed by engraving, cutting, etching, and/or removing selected portions from the face portion 4 of the printing plate 2A to form depressions in the face portion. Additionally, or alternatively, non-ink regions 10 may be treated to be hydrophilic to prevent ink from adhering to the printing plate 2A as is known by those of skill in the art. The non-ink regions 10 will not receive or transfer ink to the soft photopolymer plate. Although the non-ink region 10 illustrated in FIG. 1A is rectangular, one skilled in the art will recognize that any shape of non-ink region can be formed on the printing plate 2A, such as a circle, square, or star, an irregular shape and/or combinations thereof. The size and the location of the non-ink region 10 may also be varied. The printing plate 2A may have a common content with the other printing plates 2 used in the printing process to form a final image that will be transferred first to the soft photopolymer plate and then to a metallic container.

Figure 2A:
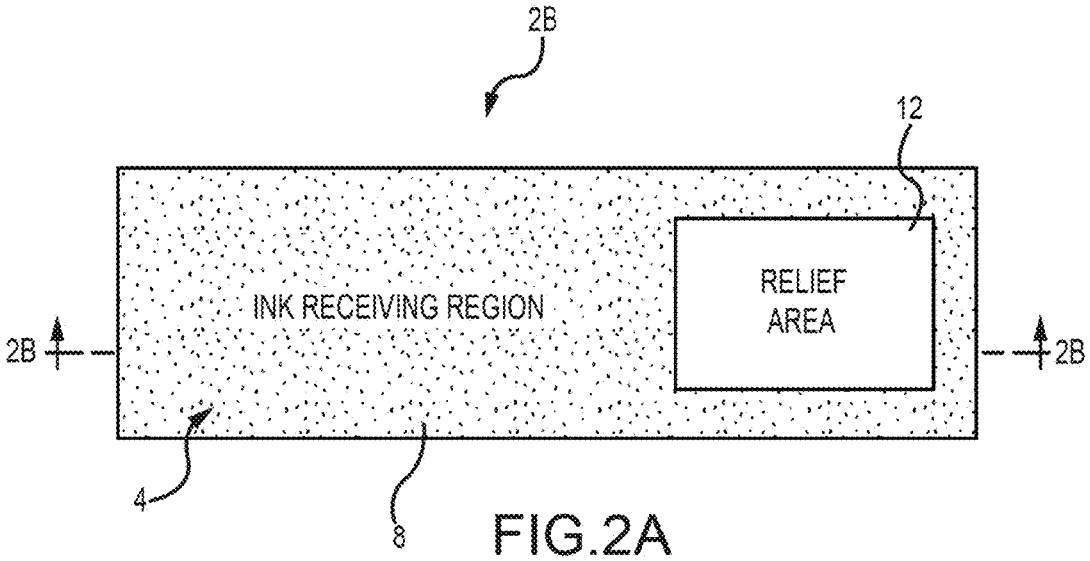
FIG. 2A is a top plan view of a printing plate with a relief area according to an embodiment of the present invention.
Figure 2B:
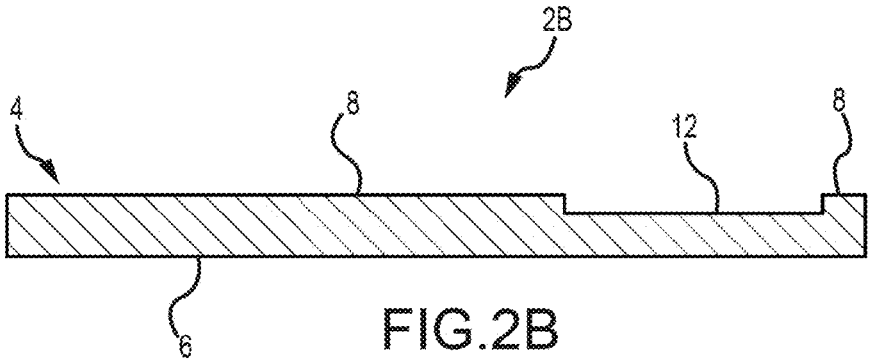
FIG. 2B is a cross-sectional elevation view of the printing plate of FIG. 2A taken along line 2B.

Printing plates 2B may also be formed with a relief area 12, as illustrated in FIGS. 2A and 2B. The relief area 12 can be formed by removing a portion of the face portion 4 of the plate 2B. Additionally, or alternatively, the relief area 12 can be formed or treated to be hydrophilic to prevent ink from adhering to the printing plate 2B. The relief area 12 will not accept ink and therefore will not transfer ink to the soft photopolymer plates. The size, location, and shape of the relief area 12 may align with the size, location, and shape of the non-ink region 10 of the printing plate 2A illustrated in FIGS. 1A and 1B. More than one relief area may be formed in each printing plate 2. Additionally, or alternatively, printing plates 2 may include both relief areas 12 and non-ink regions 10.

After one or more of the ink receiving regions 8, non-ink regions 10, and/or relief areas 12 are formed on a printing plate 2, the plate 2 is attached to a plate cylinder of a decorator, discussed below in conjunction with FIG. 5. Optionally, more than one color of ink may be used in conjunction with a corresponding inker in the printing process to form the final image. Each individual color of ink is applied by different plate cylinders. The printing plates of each plate cylinder will only receive one color of ink from an inker associated with each plate cylinder.

Figure 3A:
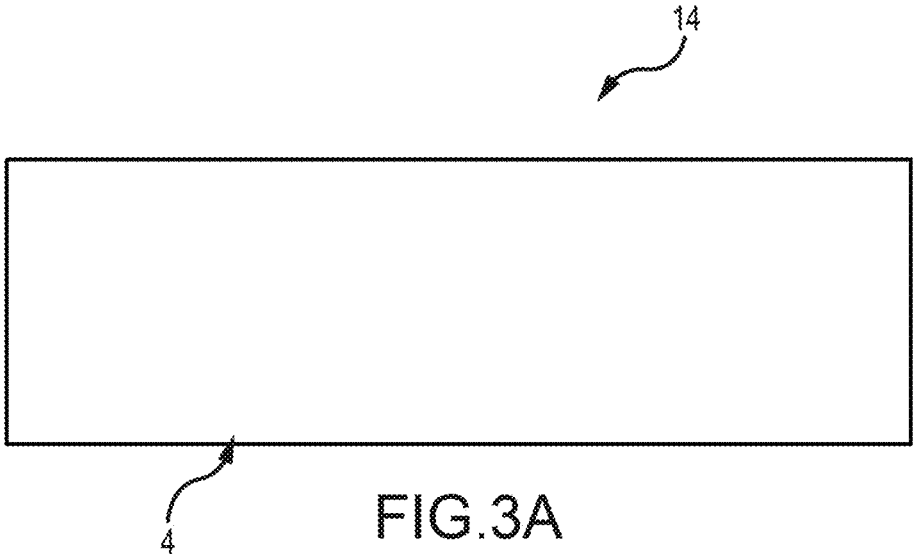
FIG. 3A is a top plan view of a soft photopolymer plate before an image is formed thereon.
Figure 3B:
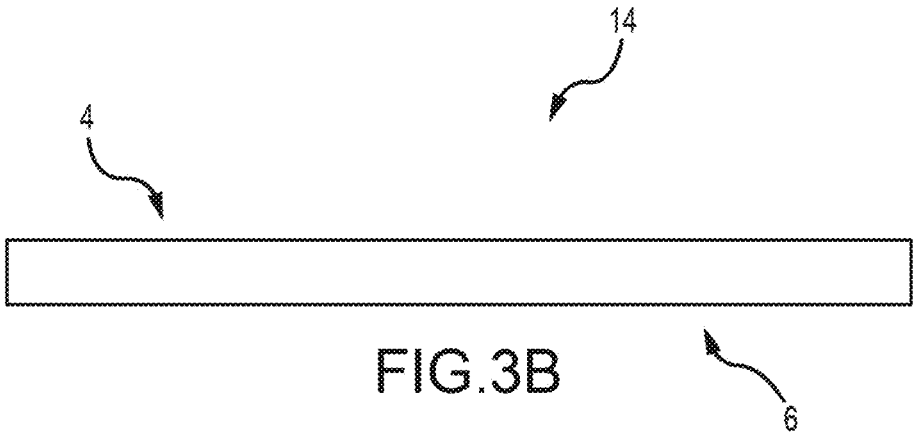
FIG. 3B is a side elevation view of the soft photopolymer plate of FIG. 3A.

FIGS. 3A and 3B illustrate a soft photopolymer plate 14 before an image has been formed on the face portion 4 of the plate. Suitable soft photopolymer plates are commercially available from a variety of sources as will be appreciated by one skilled in the art. Examples of soft photopolymer plates used for high quality printing on flexible packaging are the Cyrel® NOWS and the Cyrel® DPR plates made by DuPont™ and described in "DuPont™ Cyrel® NOWS, Rugged, High-Performance Analog Plate," available at http://www2.dupont.com/Packaging_Graphics/en_US/assets/downloads/pdf/Cyrel_NOWS.pdf and "DuPont™ Cyrel® DPR, Robust Digital Plate for Highest Quality Printing," available at http://www2.dupont.com/Packaging_Graphics/en_US/assets/downloads/pdf/DP_Cyrel_DS_DPR_us_low.pdf, which are each incorporated herein by reference in their entireties. Further, although the soft photopolymer plate 14 illustrated in FIGS. 3A and 3B has a generally rectangular shape, soft photopolymer plates are supplied in a varied of sizes and shapes that are suitable for use with the present invention.

In one embodiment the soft photopolymer plates have a thickness of about 0.04 inch to about 0.1 inch. In one preferred embodiment, the thickness of the soft photopolymer plates is from about 0.060 inch to about 0.090 inch. In another preferred embodiment, the soft photopolymer plates are about 0.05 inch thick. In still another preferred embodiment, the soft photopolymer plates are about 0.0725 inch thick. Soft photopolymer plates of other suitable thicknesses may also be used with the present invention. In one embodiment, the soft photopolymer plates have a hardness of from about 40 durometers to about 110 durometers. In a preferred embodiment, the hardness of the soft photopolymer plates is from about 60 durometers to about 100 durometers. In another preferred embodiment, the hardness of the soft photopolymer plates is from about 50 durometers to about 90 durometers. However, soft photopolymer plates that are harder or softer may be used with the method of the present invention. In one embodiment, the hardness of the soft photopolymer plates is measured after the plates have been cured and an image formed thereon as described below. The soft photopolymer plate may be made of any photo-curable material, whether made of a polymer or not. One example is a UV-curable material. Another example is made of a material cured by light of a different wavelength, not necessarily UV light. Although many such plates are made of polymer compositions today, the current invention is applicable to plates made of any material and composition that are curable by light of a desired wavelength. In one embodiment, the photopolymer plate is comprised of elastomers which are cured using a light-catalyzed photopolymerization process. In another embodiment, the photopolymer plate is comprised of chloroprene cross-linked with trimethylolpropane triacrylate. In still another embodiment, the photopolymer plate is comprised of styrene-isoprene rubber with a polyacrylate. Still other embodiments may use soft photopolymer plates comprised of other suitable light-curable materials known to those skilled in the art or developed in the future.

Soft photopolymer plates have primarily been used for creating high resolution graphics on flexible plastic packaging (such as soft plastic vegetable and produce bags), tags, labels, folding cartons, and tissue wrappers. Soft photopolymer plates are not known to have been used in the metallic container industry due to the significant challenges of high speed printing on an exterior surface of a metallic substrate.

Figure 4A:
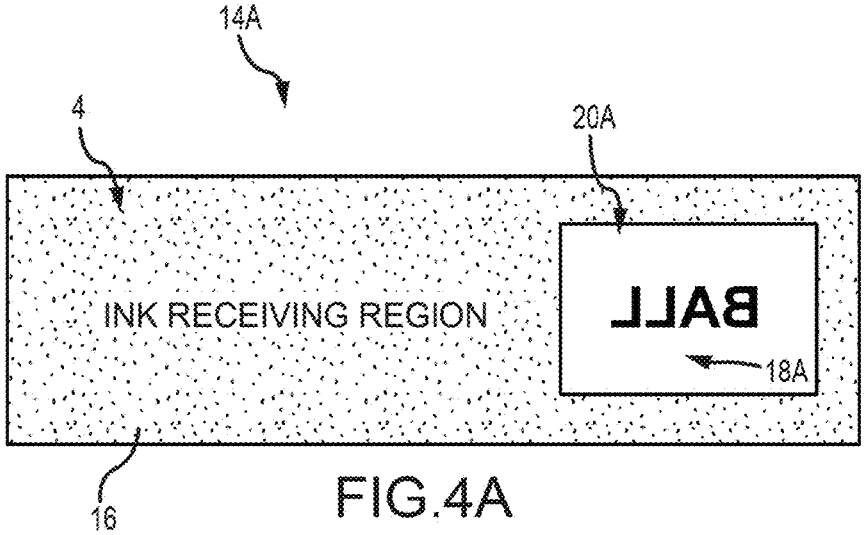
FIG. 4A is a top plan view of a soft photopolymer plate with an image formed thereon according to one embodiment of the present invention.
Figure 4B:
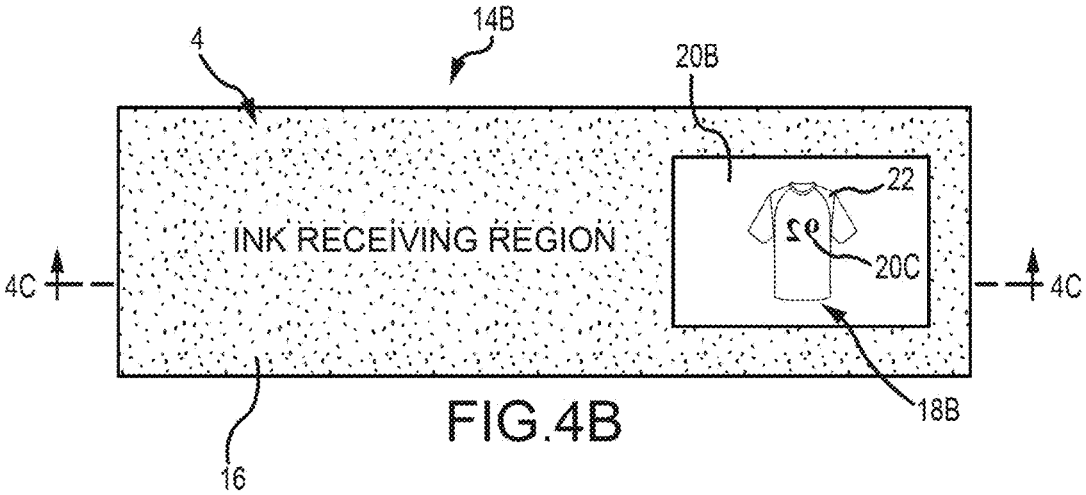
FIG. 4B is a top plan view of a soft photopolymer plate with a second image formed thereon according to another embodiment of the present invention.
Figure 4C:
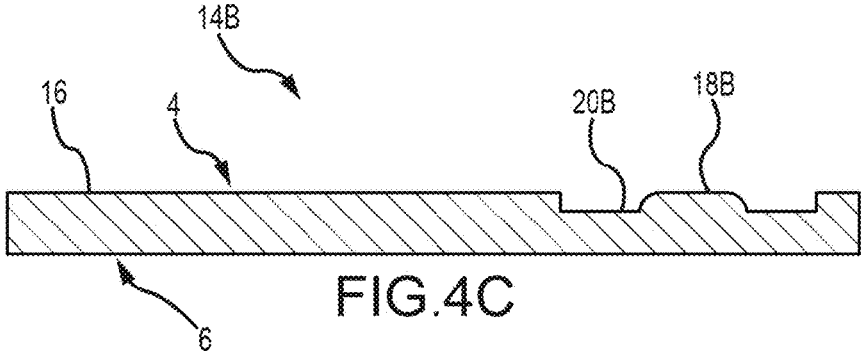
FIG. 4C is a cross-sectional elevation view of the soft photopolymer plate of FIG. 4B taken along line 4C.

Referring now to FIGS. 4A-4C, soft photopolymer plates 14A, 14B are illustrated with images 18 formed thereon. The face portions 4 of the soft photopolymer plates 14A, 14B include ink receiving regions 16. An image 18A of the word "BALL" is formed on the soft photopolymer plate 14A. An image 18B of a sports jersey is formed on the other soft photopolymer plate 14B. Both of the images 18A, 18B are formed of exposed and hardened material of the soft photopolymer plates 14A, 14B.

Images are formed on the soft photopolymer plates 14 with a computer to plate (CTP) process, a conventional plate exposure process, or any other suitable method. A piece of soft photopolymer plate 14 with a Mylar backing is generally used as a backing, although other materials commonly known by one skilled in the art may also be employed as a backing. An image 18 to be printed onto an exterior surface of the metallic container is formed.

In the conventional plate exposure process, a film negative of the image 18 is created. The film negative is placed on a predetermined portion of the face portion 4 of the soft photopolymer plate 14. The soft photopolymer plate 14 with the film negative is then placed into an exposure device that exposes the soft photopolymer plate and the film negative to a light source. The film negative acts as a negative mask that blocks and prevents some of the light from reaching the face portion 4 of the soft photopolymer plate 14. The light shines through the clear sections of the film negative and hardens the material of the soft photopolymer plate 14. Exposure time to an ultraviolet light source may range from approximately 0.01 minute to approximately 10 minutes.

The material on the face portion 4 of the soft photopolymer plate 14 hardens where light passes through the film negative and strikes the face portion 4. Portions of the soft photopolymer plate 14 that are not covered by the film negative are also exposed to the light and harden. The material on the face portion of the soft photopolymer plate 14 under the areas of the film negative that block the light, or some of the light, remain unexposed and soft.

Using the CTP process, the image 18 is transferred directed to the plate in a digital imager apparatus. The digital imager apparatus ablates, or otherwise removes, portions of an opaque mask coating on the face portion 4 of the soft photopolymer plate 14 to form a negative of the image 18. The soft photopolymer plate 14 is then placed into an exposure device that exposes the soft photopolymer plate to a light source. The exposure device may be the same as, or similar to, the exposure device used in the conventional plate exposure process described above. Portions of the mask coating that were not ablated block light and prevent the light from reaching the face portion 4 of the soft photopolymer plate 14. The polymer material of the soft photopolymer plate 14 under remaining portions of the mask coating remains unexposed and soft. Light from the exposure device contacts the polymer material of the soft photopolymer plate in the image areas where the mask coating has been removed and hardens the material of the soft photopolymer plate 14. Exposure time to an ultraviolet light source may range from approximately 0.01 minute to approximately 10 minutes. An example of the CTP process is described in "Advancing Flexography, The Technical Path Forward" by Ray Bodwell and Jan Scharfenberg, available at http://www2.dupont.com/Packaging_Graphics/en_US/assets/downloads/pdf/Adv-Flexo_Brochure.pdf, which is herein incorporated by reference in its entirety. Examples of suitable digital imager apparatus are described in "Cyrel™ Digital flex plate Imagers (CDI)," available at http://www2.dupont.com/Packaging_Graphics/en_GB/assets/downloads/pdf/CDI_family_English.pdf, which is herein incorporated by reference in its entirety.

Once the image is transferred to the soft photopolymer plate 14 using either the CTP process or the conventional plate exposure process, the soft, unexposed polymer material on the face portion 4 of the exposed soft photopolymer plate 14 is removed. In one embodiment, the exposed soft photopolymer plate 14 is placed in a washing station. The unexposed, soft polymer material on unexposed areas of the face portion 4 of the soft photopolymer plate 14 is removed by washing and scrubbing the face portion 4. The washing station may include either water or a solvent, such as Cyrel Nutre-Clean. As will be appreciated, other solutions and solvents may be used in the washing station. In another embodiment, the unexposed polymer material is removed from the face portion by a post processing apparatus that does not use solvents and/or other liquids. The post processing apparatus may use thermal energy and a developer roll to remove the unexposed polymer material. After the soft, unexposed polymer material is removed, the soft photopolymer plate 14 may be exposed to light a second time to complete polymerization and ensure all areas of the plate have been hardened and to attain maximum durability.

When the unexposed soft material on areas of the face portion 4 of the soft photopolymer plate 14 have been removed, the face portion 4 will have relief areas 20 that will not receive ink and hardened areas forming images 18 that can receive ink. The image 18 formed on the soft photopolymer plate can be three dimensional and have different depths in the face portion 4 depending on the amount of light that passed through the film negative or the masking coating. The image 18, or portions of the image, have a depth of about 0.0009 inch to about 0.089 inch. In a more preferred embodiment, the depth of the image 18, or within portions of an image 18, is from approximately 0.001 inch to approximately 0.084 inch deep. In some embodiments, the soft photopolymer plates 14 may also be etched or engraved on the face portion 4 before, during, or after the curing process to form one or more additional recessed portions. The etched or engraved areas may be formed using a laser or any other means known by those of skill in the art.

Figure 6A:
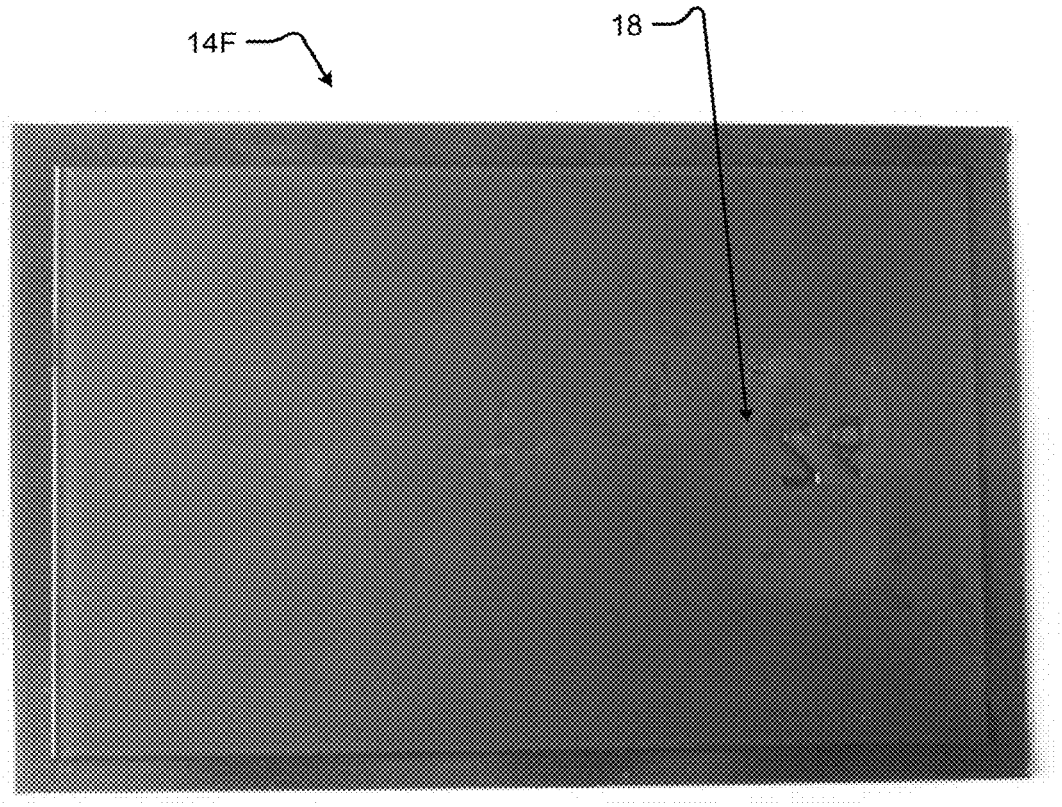
FIG. 6A is a photograph of a soft photopolymer plate with an image formed thereon according to various embodiments of the present invention.
Figure 6B:
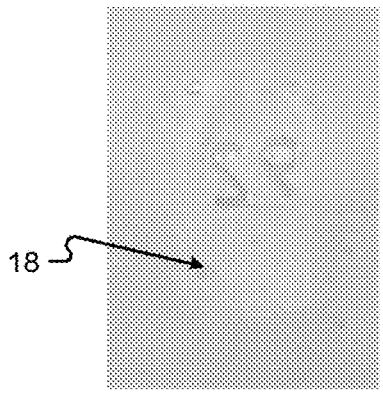
FIG. 6B is an enlarged photograph of the image formed on the soft photopolymer plate of FIG. 6A.

The images 18 have a maximum thickness equal to the original thickness of the photopolymer plate 14. The images 18A, 18B can be surrounded by relief areas 20A, 20B that were not exposed and therefore remained soft. The unexposed, soft material of the soft photopolymer plates was subsequently removed to form the relief areas 20A, 20B. The size, location, and shape of the relief area formed in the soft photopolymer plates may align with the size, location, and shape of the non-ink region 10 illustrated in FIG. 1A and the relief area 12 illustrated in FIG. 2A. The relief areas 20A, 20B of the photopolymer plates 14A, 14B will not accept ink from the printing plates 4 and may be used to create unique, undecorated areas (or non-inked areas) on the metallic container. The image 20 can include a relief area 20C that will not receive ink and can also include screened areas 22 that receive less ink than other portions of the image as illustrated in FIG. 4B. Although FIGS. 4A, 4B, and 4C illustrate an image surrounded by a relief area, it should be understood that an image 18 may be formed on the soft photopolymer plate with no relief area surrounding the image 18, as shown in FIGS. 6A and 6B.

After the image 18 has been formed on the face portion 4 of the soft photopolymer plate 14, an adhesive transfer tape or adhesive stickyback may be added to the Mylar portion or other backing on the back portion 6 of the soft photopolymer plate 14. Suitable adhesive stickyback is available from a variety of commercial suppliers. In one embodiment, the adhesive stickyback is about 2.0 mil (or about 0.002 inch) thick. In another embodiment, the adhesive stickyback is about 15 mil (or about 0.015 inch) thick. The soft photopolymer plate 14 with the stickyback on the back portion 6 is then attached to the blanket cylinder of the decorator.

Although not illustrated in FIGS. 1-4, it will be appreciated by one of skill in the art that one or more of the printing plates 2 and/or the soft photopolymer plates 14 may have print registration areas that are used to monitor the registration of different colors printed by different plates 2, 14 to form an image on the metallic container. For example, print registration areas may be provided on the printing plates 2 to monitor the location and alignment of print content on metallic containers.

Figure 5:
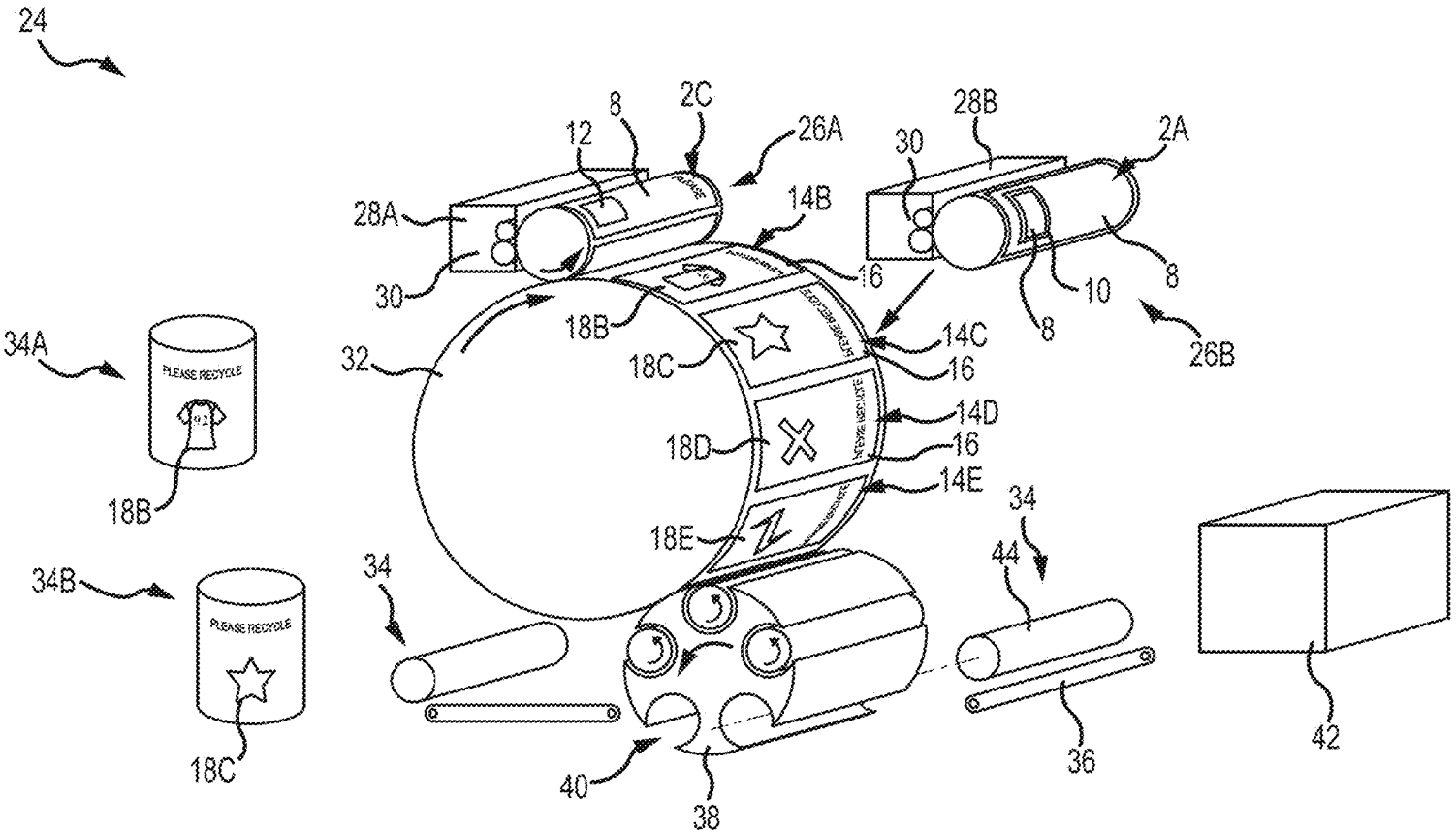
FIG. 5 is a schematic illustration of one embodiment of a decorator of the present invention using soft photopolymer plates to decorate metallic containers.

Referring now to FIG. 5, a decorator 24 using soft photopolymer plates 14 to form multiple images on metallic containers is illustrated. The decorator 24 includes at least one plate cylinder 26. One or more printing plates 2 are attached to each of the plate cylinders 26. Additionally, or alternatively, the printing plate 2 can be a sleeve or cylinder that wraps around a circumference of the plate cylinder 26. The plate cylinders 26 are operable to rotate in a first direction. Inkers 28 with rollers 30 are associated with each plate cylinder 26. The rollers 30 of each inker 28 transfer one color of ink to the ink receiving regions 8 of the printing plates 2. A first color of ink may be applied to the printing plates of the first plate cylinder 26A and a second color of ink may be applied to the printing plates of the second plate cylinder 26B. More colors of ink may be used if additional plate cylinders 26 are provided.

In the example illustrated in FIG. 5, the printing plates 2 of the first plate cylinder 26A include common content, the words "Please Recycle," in ink receiving regions 8 that will be transferred to all of the soft photopolymer plates 14. However, as will be appreciated by one of skill in the art, the printing plates do not have to include an image. For example, the printing plates can transfer ink to the soft photopolymer plates 14 without transferring an image to the soft photopolymer plates. The first and second plate cylinders 26A, 26B can include printing plates 2 with one or more relief areas 12 and non-ink regions 10. In one embodiment, a relief area 12 may be formed in the same location of all of the printing plates 2 except for one printing plate which does not have a relief area. The relief areas 12 formed in the printing plates 2 do not receive ink from the inkers 28 and will not transfer ink to the photopolymer plates 14. The one printing plate 2 without a relief area will transfer ink to all images 18 and ink receiving regions 16 of the soft photopolymer plates 14 that contact the ink receiving regions 8 of the face portion 4 of the one printing plate 2 without a relief area. Additionally, or alternatively, one or more printing plates 2 can transfer different colors of ink to the same location of the soft photopolymer plates 14. Thus, different colors of ink may be transferred from one or more printing plates 2 to the same location of the soft photopolymer plates 14 in overlapping layers.

The decorator 24 also includes a blanket cylinder 32 to which one or more soft photopolymer plates 14 are attached. Additionally, or alternatively, the one or more soft photopolymer plates 14 can be a sleeve or cylinder of a soft photopolymer material that wraps around the circumference of the blanket cylinder 32. The blanket cylinder 32 rotates in a second direction opposite to the first direction of the plate cylinder 26. Each soft photopolymer plate 14 may have a different image 18 formed thereon. For example, the soft photopolymer plates 14 illustrated in FIG. 5 include an image 18B of a sports jersey, an image 18C of a star, an image 18D of an "X," and an image 18E of a lightning bolt formed thereon. The images 18 on the soft photopolymer plates 14 can be formed in locations corresponding to, or aligning with, the relief areas 12 of the printing plates 2. The images 18 of the soft photopolymer plates 18 may be negatives (formed by relief areas 20 that will not receive ink) that leave non-inked areas on the decorated container, or the images 18 may be positives (formed by exposed, hardened areas of the soft photopolymer plates 14) that will receive ink when the images 18 contact one or more ink receiving regions 8 of the printing plates 2 that have received ink from an inker 28. The images 18 can also include combinations of negative and positive areas. It will be understood by those of skill in the art that a positive image will apply ink to a metallic container and a negative image means an absence of ink in a printed or positive part of an image.

The plate cylinders 26 rotate in the first direction and the blanket cylinder 32 rotates in the second opposite direction in unison to bring the printing plates 2 into contact with the soft photopolymer plates 14. Ink is transferred to the ink receiving regions 16 and images 18 of the soft photopolymer plates 14 that contact the inked ink receiving regions 8 of the printing plates 2. The main image exposure occurs on the inked printing plates 2 and a secondary image is produced by the soft photopolymer plates 14. The soft photopolymer plates 14 may have ink receiving regions 16 that are common for all of the soft photopolymer plates 14. The areas where images 18 are formed on the soft photopolymer plates, such as the images 18A, 18B illustrated in FIGS. 4A and 4B, will create unique inked areas for each soft photopolymer plate 14. The process is similar to a stamp ink pad and rubber stamp where only the raised portion of the rubber stamp collects ink from the ink pad and transfers the ink to a substrate as an image. Relief areas 20 of the soft photopolymer plates 14 will not receive ink from the printing plates 2. Only the exposed, hardened areas of the soft photopolymer plates 14 will receive ink from the printing plates 2 and transfer the ink onto the surface of the metallic containers. By using soft photopolymer plates 14 with different images 18 formed thereon a completely different image will be printed on each metallic container. This results in multiple lithographic images being produced from a single set of printing plates 2 on the plate cylinders 26 of the decorator 24. The process uses high-definition solid and screened images formed on the soft photopolymer plates 14 resulting in unique ink transfer to metallic containers.

In operation, a metallic container 34 is fed to a support cylinder 38 by a conveyor 36 or other means from a storage location or facility 42. The support cylinder 38 has a plurality of stations 40 adapted to receive and hold a metallic container 34 in a predetermined position aligned with the soft photopolymer plates 14. The stations 40 can hold the metallic containers 34 in a stationary position and can also rotate the metallic containers 34 about each container's longitudinal axis. As the blanket cylinder 32 rotates in the second direction, the support cylinder 38 rotates in unison in the first direction to bring an exterior surface 44 of the metallic container 34 into rotational contact with an inked soft photopolymer plate 14 attached to the blanket cylinder 32. The ink is then transferred from the soft photopolymer plate 14 to the exterior surface 42 of the metallic container 34. Although a support cylinder 38 is illustrated in FIG. 5, it should be understood that other means of supporting the metallic containers 34 and bringing the exterior surface 44 of them into contact with the soft photopolymer plates 14 may be used, such as a mandrel wheel or a conveyor belt.

Two decorated metallic containers 34A, 34B are also illustrated in FIG. 5. The decorated metallic containers include common content (the words "Please Recycle"). Container 34A includes unique content, the image 18B of a sports jersey, and container 34B includes a unique image 18C of a star.

Decorators 24 used in the commercial metallic container industry may have blanket cylinders 32 with from 8 to 12 individual soft photopolymer plates 14 attached. When each of the 8 to 12 individual soft photopolymer plates 14 has a unique image 18 formed thereon, the decorator 24 can produce from 8 to 12 different lithographic images without changing the printing plates 2. The present invention will work with a blanket cylinder 32 with any number of soft photopolymer plates 14 attached to its circumference. In addition, although the soft photopolymer plates 14 are illustrated in FIG. 5 as individual photopolymer plates, in some embodiments the blanket cylinder 32 may have one continuous blanket of a soft photopolymer material affixed to its circumference, the continuous blanket having multiple unique images formed thereon.

Referring now to FIG. 6A, a photograph of a soft photopolymer plate 14F with an image 18 of a sports jersey with the number "92" formed thereon according to various embodiments of the present invention is provided. FIG. 6B is an enlarged photograph of the image 18 of FIG. 6A. In the embodiment illustrated in FIGS. 6A and 6B, the image 18 is not surrounded by a relief area.

Figure 7B:
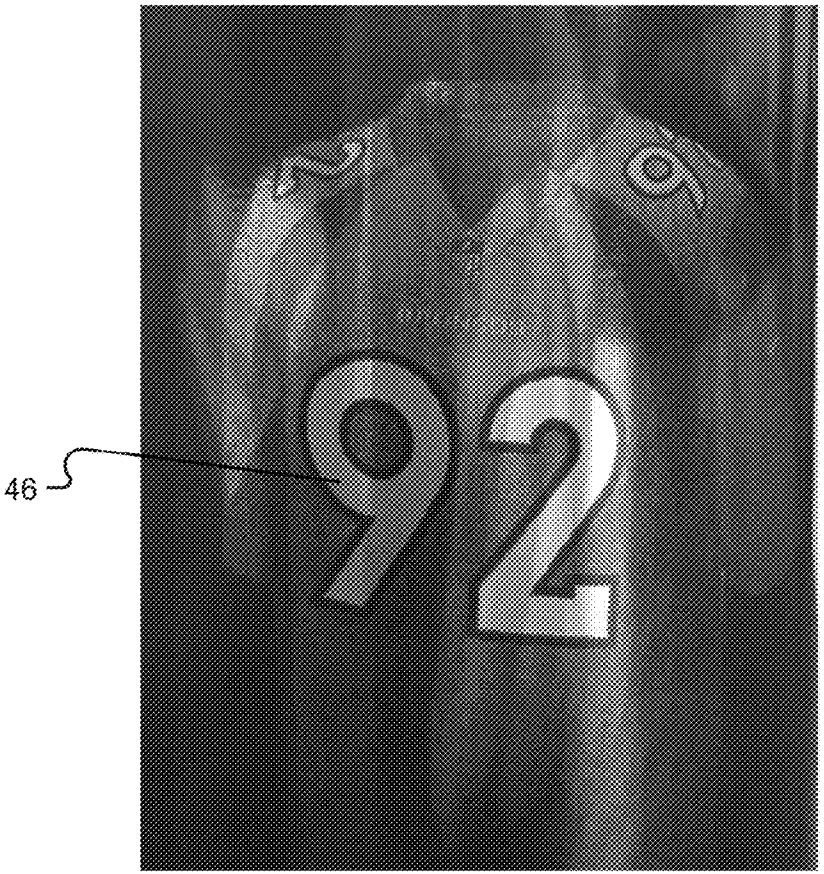
FIG. 7B is an enlarged photograph of the metallic can of FIG. 7A.
Figure 7A:
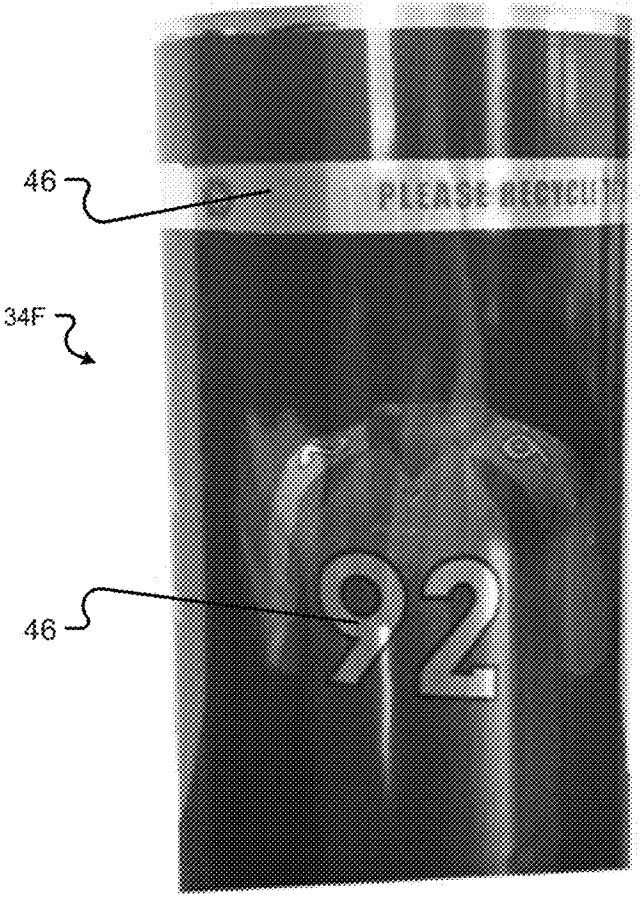
FIG. 7A is a photograph of a metallic container decorated according to various embodiments of the present invention using the soft photopolymer plate of FIG. 6A.

Referring now to FIG. 7A, a photograph of a generally cylindrical metallic container decorated according to various embodiments of the present invention with the photopolymer plate 14F shown in FIG. 6A is provided. FIG. 7B is an enlarged portion of the photograph of FIG. 7A. The photographs show a generally cylindrical metallic container 34F decorated with a sports jersey which includes the number "92" formed in a non-inked portion 46 (or negative) of the decoration. Other numbers, shapes, words, or designs could be formed to decorate a substrate using the present invention.

Figure 8:
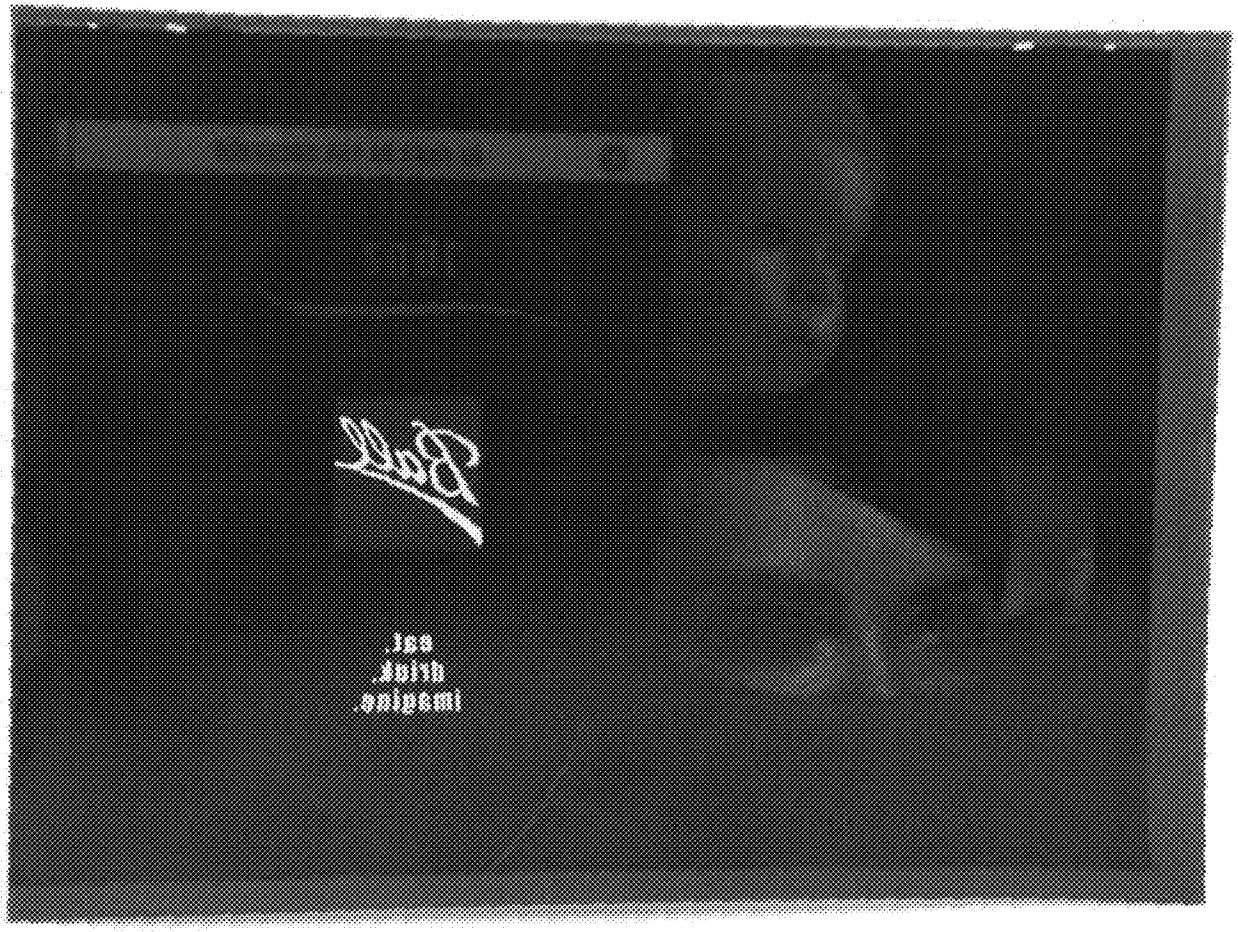
FIG. 8 is a photograph of a soft photopolymer plate with images formed thereon according to various embodiments of the present invention.
Figure 9:
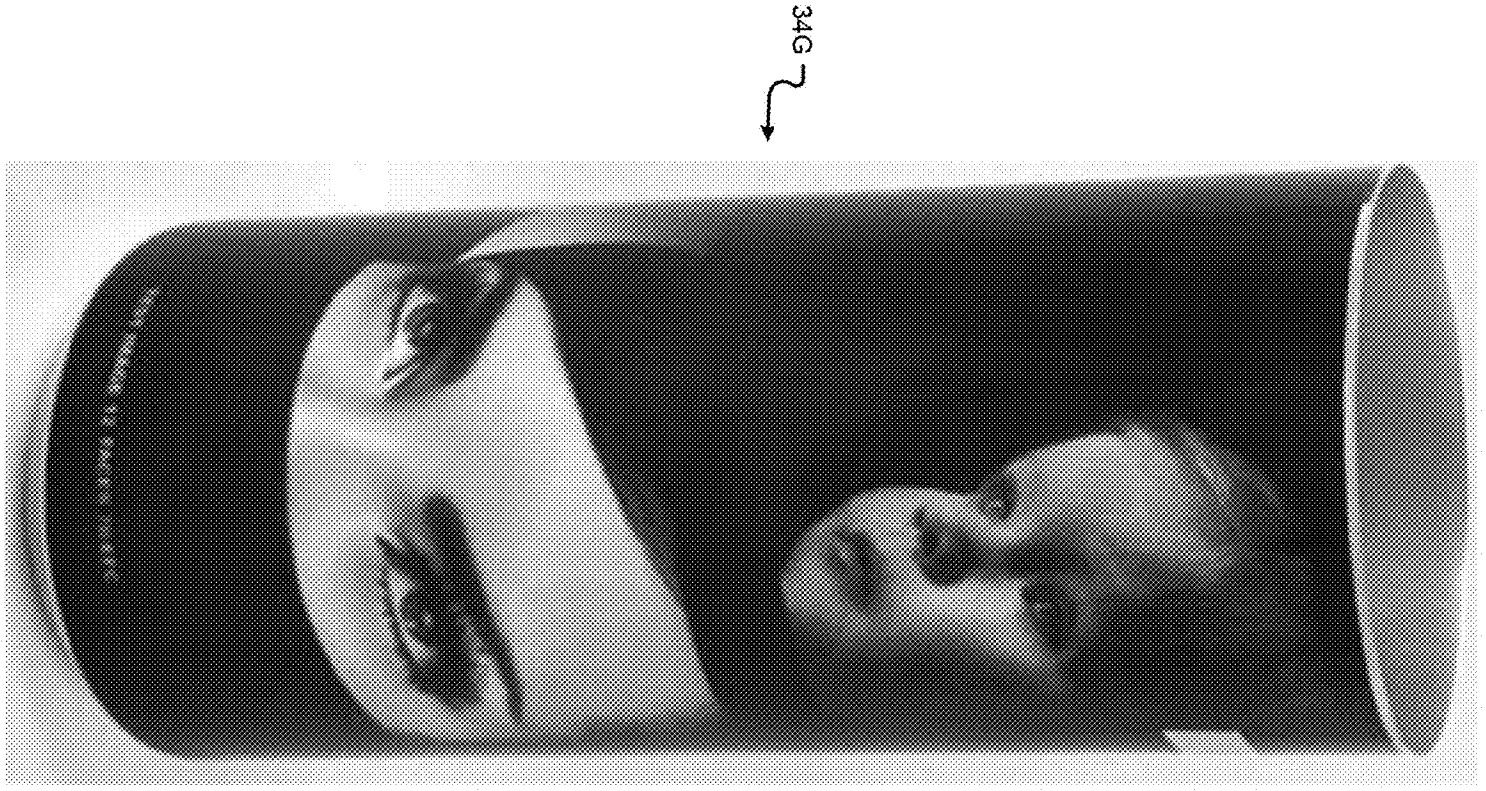
FIG. 9 is a photograph of a metallic container decorated according to various embodiments of the present invention using the soft photopolymer plate of FIG. 8.
Figure 10A:
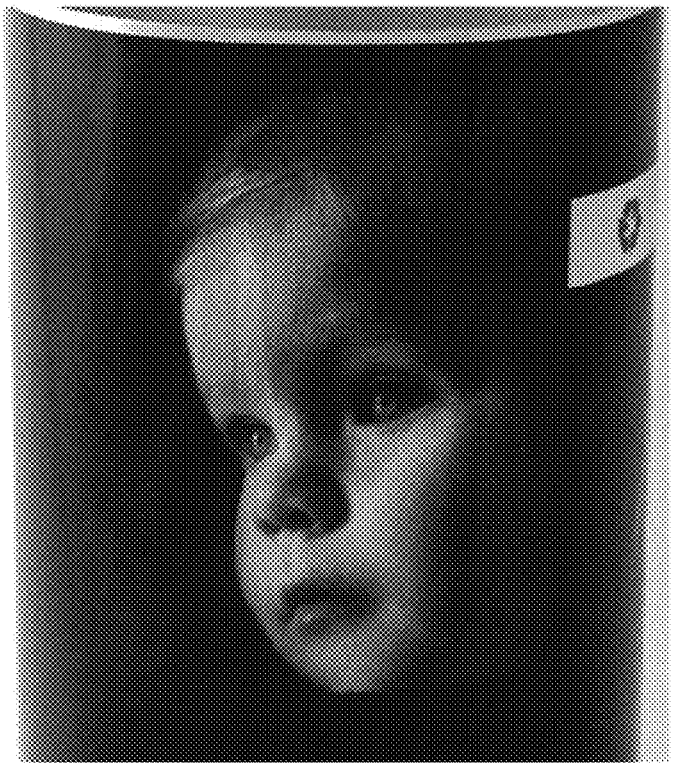
FIG. 10A is an enlarged photograph of a first image formed on the metallic container of FIG. 9 using the soft photopolymer plate of FIG. 8.
Figure 10B:
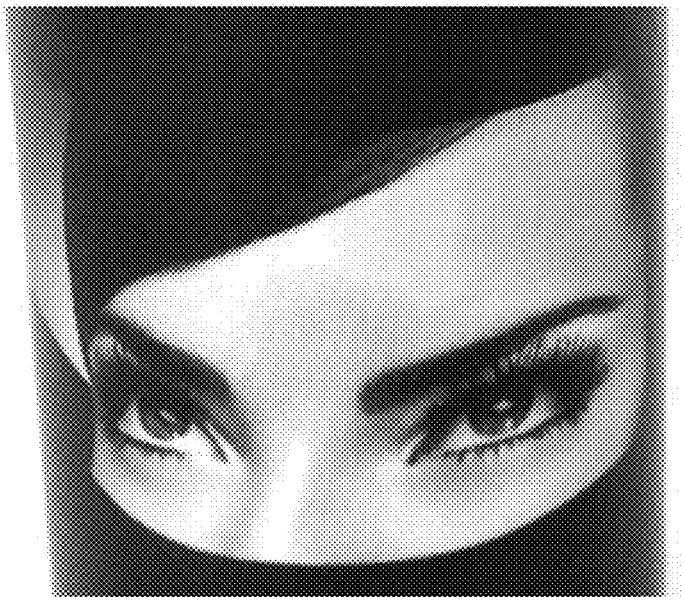
FIG. 10B is a second enlarged photograph of a second image formed on the metallic container of FIG. 9 using the soft photopolymer plate of FIG. 8.

Referring now to FIG. 8, a photograph of another soft photopolymer plate 14G with several images formed thereon according to various embodiments of the present invention is provided. A photograph of a generally cylindrical metallic container 34G decorated according to various embodiments of the present invention using the soft photopolymer plate 14G of FIG. 8 is shown in FIG. 9. FIGS. 10A and 10B provide enlarged photographs of a first image and a second image formed on the metallic container 34G shown in FIG. 9.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. An apparatus for forming a high-definition lithographic image on an exterior surface of a metallic container, comprising:

a first inker operable to transfer a first ink to a first printing plate attached to a circumference of a first plate cylinder;

a second inker operable to transfer a second ink to a second printing plate attached to a circumference of a second plate cylinder, wherein the second printing plate includes a relief area that will not receive the second ink;

a blanket cylinder having one or more printing blankets affixed to a circumference of the blanket cylinder, each of the printing blankets having an image with a depth extending below a plane defined by a face portion of a printing blanket, the blanket cylinder operable to move the printing blankets into rotational contact with the first and second printing plates attached to the first and second plate cylinders, wherein the first ink is transferred from the first printing plate to the image on each of the printing blankets, and wherein the second ink is transferred from the second printing plate to a portion of each of the printing blankets, and wherein the relief area will not transfer the second ink to the image on each of the printing blankets; and a support cylinder operable to move the metallic container into contact with a printing blanket affixed to the blanket cylinder, wherein the first and second inks are transferred from the printing blanket to the exterior surface of the metallic container to form the high-definition lithographic image.

2. The apparatus of claim 1, wherein at least one of the printing blankets includes a relief area positioned around an image formed on the printing blanket.

3. The apparatus of claim 2, wherein the relief area does not accept ink from the printing plates such that an uninked area is formed on the metallic container.

4. The apparatus of claim 1, wherein each of the printing blankets comprises a photopolymer material with a different image formed thereon, and wherein each of the different images are formed by creating a film negative of each different image, placing the film negatives on predetermined portions of the printing blankets, exposing the printing blankets and the film negatives to light, removing the film negatives from the printing blankets, and cleaning the photopolymer material to remove unexposed material.

5. The apparatus of claim 1, wherein each of the images are formed in a same location on each of the printing blankets and the images align with the relief area of the second printing plate.

6. The apparatus of claim 1, wherein the depth is from about 0.0009 inch to about 0.089 inch.

7. The apparatus of claim 1, wherein the images are formed by removing material from the face portions of the printing blankets.

8. A decorator to decorate exterior surfaces of a plurality of metallic containers with different images, comprising:

a first plate cylinder with a first printing plate which includes a first ink receiving region and a relief area that will not receive ink;

a first inker to transfer a first ink to the first ink receiving region;

a second plate cylinder with a second printing plate which includes a second ink receiving region;

a second inker to transfer a second ink to the second ink receiving region; and a blanket cylinder aligned with the first and second plate cylinders, the blanket cylinder including a first transfer plate and a second transfer plate, the first transfer plate including a first image and the second transfer plate including a second image, at least a portion of the first and second images having a depth that extends below a face portion of the respective first and second transfer plates, wherein the blanket cylinder is operable to rotate with respect to the first and second plate cylinders such that the first ink receiving region of the first printing plate transfers the first ink to a portion of each of the first and second transfer plates and the second ink receiving region of the second printing plate transfers the second ink to the first and second images, wherein the relief area of the first printing plate aligns with the first and second images, wherein the first transfer plate subsequently contacts an exterior surface of a first metallic container which is decorated with the first ink and with the first image, and wherein the second transfer plate subsequently contacts an exterior surface of a second metallic container which is decorated with the first ink and with the second image.

9. The decorator of claim 8, wherein the first transfer plate comprises a photopolymer material from which some of the photopolymer material has been removed from the face portion to reveal the first image.

10. The decorator of claim 9, wherein portions of the first image have different depths.

11. The decorator of claim 8, wherein the first image of the first transfer plate is surrounded by a relief area that will not receive ink from the first and second printing plates such that the first image formed on the first metallic container is surrounded by a non-inked area.

12. The decorator of claim 8, further comprising a support cylinder to move the first and second metallic containers into contact with the first and second transfer plates.

13. The decorator of claim 8, wherein at least one of the first and second transfer plates is comprised of at least one of an elastomer which is curable by a photopolymerization process, a chloroprene cross-linked with trimethylolpropane triacrylate, and a styrene-isoprene rubber with a polyacrylate.

14. The decorator of claim 8, wherein no portion of the first image projects above a first plane defined by the face portion of the first transfer plate.

15. The decorator of claim 8, wherein the depth of the first image on the first transfer plate is from about 0.0009 inch to about 0.089 inch.

16. A decorator with a photopolymer plate to decorate an exterior surface of a generally cylindrical container, comprising:

a blanket cylinder;

a first photopolymer plate affixed to the blanket cylinder, the first photopolymer plate including a first image formed thereon, wherein at least a portion of the first image has a depth that is lower than a first plane defined by a face portion of the first photopolymer plate and no portion of the first image projects above the first plane;

a first plate cylinder;

a first printing plate interconnected to the first plate cylinder, wherein the first printing plate is operable to transfer a first ink to at least a portion of the first photopolymer plate;

a second plate cylinder;

a second printing plate interconnected to the second plate cylinder, the second printing plate including a second image, wherein the second printing plate is operable to transfer a second ink from the second image to the first photopolymer plate, and wherein the second printing plate does not transfer the second ink to the first image; and a support element to move the generally cylindrical container into contact with the first photopolymer plate, wherein the first and second inks are transferred from the first photopolymer plate to the exterior surface of the generally cylindrical container to form the first and second images on the generally cylindrical container.

17. The decorator of claim 16, wherein the first photopolymer plate is comprised of a photo-curable material that has been cured by light to form the first image.

18. The decorator of claim 16, wherein the first image on the first photopolymer plate is a negative comprising relief areas that will not receive ink from the first printing plate.

19. The decorator of claim 16, further comprising a second photopolymer plate affixed to the blanket cylinder, the second photopolymer plate including a third image formed thereon, wherein the first printing plate is operable to transfer the first ink to at least a portion of the second photopolymer plate and the second printing plate is operable to transfer the second ink from the second image to the second photopolymer plate, wherein the second printing plate does not transfer the second ink to the third image, and wherein the first and second inks are subsequently transferred from the second photopolymer plate to an exterior surface of a second generally cylindrical container to form the second and third images on the second generally cylindrical container.

20. The decorator of claim 16, wherein the first image on the exterior surface of the generally cylindrical container is formed of the first ink and the second image is formed of the second ink.

* * * * *